US012674647B2

(12) United States Patent
Peterson et al.

(10) Patent No.: US 12,674,647 B2
(45) Date of Patent: Jul. 7, 2026

(54) RAIL SYSTEM FOR A REVOLVER

(71) Applicants: Cole A. Peterson, Little Canada, MN (US); Adam R. Renfroe, Victoria, MN (US)

(72) Inventors: Cole A. Peterson, Little Canada, MN (US); Adam R. Renfroe, Victoria, MN (US)

( * ) Notice: Subject to any disclaimer, the term of this patent is extended or adjusted under 35 U.S.C. 154(b) by 0 days.

(21) Appl. No.: 18/947,920

(22) Filed: Nov. 14, 2024

(65) Prior Publication Data

US 2026/0133012 A1 May 14, 2026

(51) Int. Cl.
*F41G 11/00* (2006.01)
*F41G 1/02* (2006.01)

(52) U.S. Cl.
CPC ..... *F41G 11/003* (2013.01); *F41G 1/02* (2013.01)

(58) Field of Classification Search
CPC ..... F41G 11/003; F41G 11/004
See application file for complete search history.

(56) References Cited

U.S. PATENT DOCUMENTS

| | | | | |
|---|---|---|---|---|
| 4,328,624 | A * | 5/1982 | Ross | F41G 11/003 D22/110 |
| 2012/0090214 | A1* | 4/2012 | Castaneda | F41G 11/003 42/90 |
| 2014/0047755 | A1* | 2/2014 | McClintock | F41G 11/003 42/90 |
| 2014/0157644 | A1* | 6/2014 | Jiminez | F41G 11/003 42/114 |
| 2016/0363416 | A1* | 12/2016 | Klotz | F41C 27/00 |
| 2022/0364822 | A1* | 11/2022 | Weinberger | F41C 27/00 |
| 2024/0093967 | A1* | 3/2024 | Karagias | F41G 11/001 |

* cited by examiner

*Primary Examiner* — Bret Hayes
(74) *Attorney, Agent, or Firm* — Jonas R. Mellang; Kelly, Holt & Christenson, P.L.L.C.

(57) ABSTRACT

A rail system is configured to be mounted to a revolver. The rail system can be configured as a quad rail system. The rail system can be assembled onto a revolver without altering the revolver. The quad rail system can be used to mount accessories to the revolver.

21 Claims, 10 Drawing Sheets

RAIL SYSTEM FOR A REVOLVER

FIELD OF THE DESCRIPTION

The present description relates to revolvers. More specifically, the present description relates to a rail system for a revolver.

BACKGROUND

A revolver is a repeating handgun with a revolving cylinder containing multiple chambers, each holding a single cartridge. When the trigger is pulled, the hammer strikes the primer of the cartridge, igniting the propellant and firing the bullet down the barrel. The cylinder then rotates to position the next chamber in front of the barrel for the next shot.

The cylinder can be opened by actuating a cylinder release actuator. The cylinder is then rotated out of the frame group on a crane so that the chambers in the cylinder are exposed. When the cylinder is open, cartridges can be loaded into the chambers and removed from the chambers. The cylinder can then be closed by rotating the cylinder back into place until it locks within the frame group.

The discussion above is merely provided for general background information and is not intended to be used as an aid in determining the scope of the claimed subject matter.

SUMMARY

A rail system is configured to be mounted to a revolver. The rail system can be configured as a single or multi rail system. The rail system can be assembled onto a revolver without altering the revolver. The rail system can be used to mount accessories to the revolver.

This Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter. The claimed subject matter is not limited to implementations that solve any or all disadvantages noted in the background.

DETAILED DESCRIPTION

Figure 1:
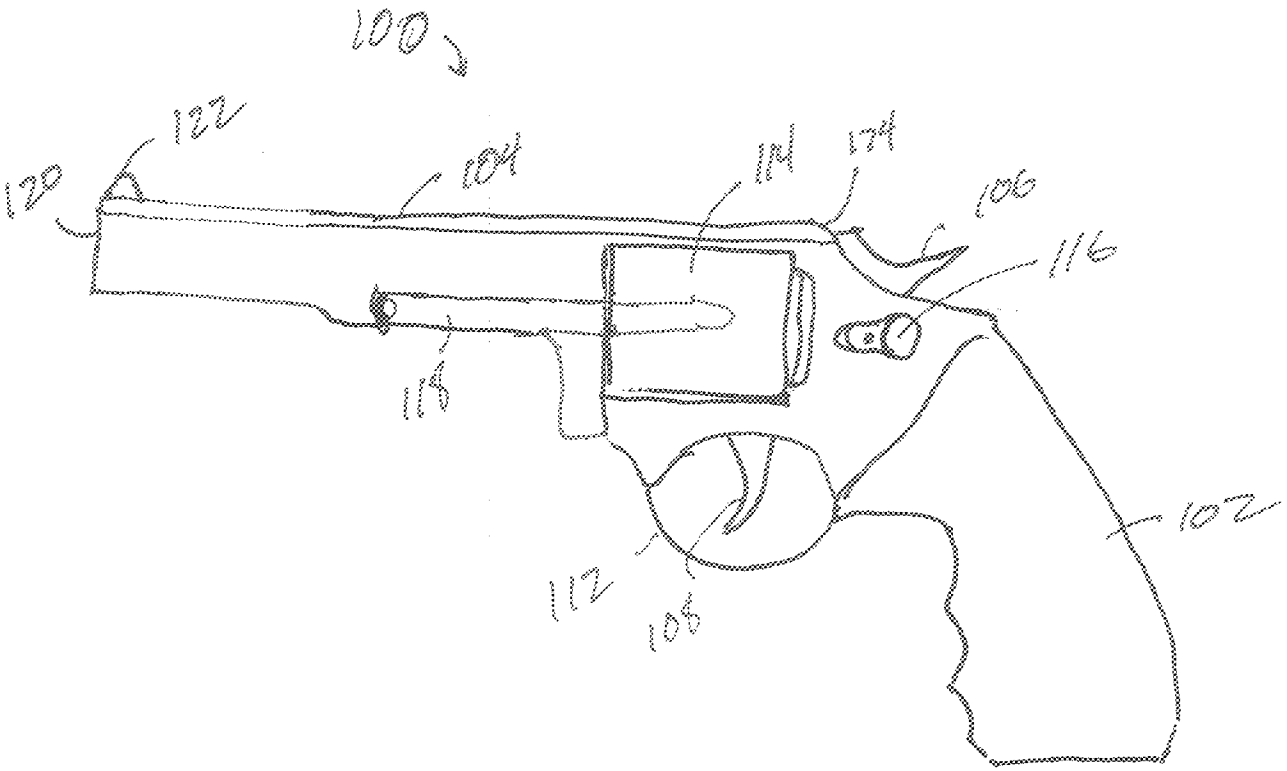
FIG. 1 PRIOR ART
FIG. 1 is a side pictorial view of one example of a known revolver.

For purposes of promoting an understanding of the principles of the present disclosure, reference will now be made to the examples illustrated in the drawings, and specific language will be used to describe the same. It will nevertheless be understood that no limitation of the scope of the disclosure is intended. Any alterations and further modifications to the described devices, systems, methods, and any further application of the principles of the present disclosure are fully contemplated as would normally occur to one skilled in the art to which the disclosure relates. In particular, it is fully contemplated that the features, components, and/or steps described with respect to one example may be combined with the features, components, and/or steps described with respect to other examples of the present disclosure.

Modern weapon systems often employ a rail system, such as a weaver rail system or a picatinny rail system or an M-lok rail system, that allows the operator to mount optics (e.g. scopes, sights, etc.) and/or accessories (e.g., bipods, lights, lasers, etc.) to the weapon. To mount a rail system to a revolver, some current approaches have altered the revolver, such as by drilling or milling holes into the frame group of the revolver so that the rail system can be attached. Current rail systems that have been used with revolvers have provided very limited functionality. Some such current systems, for instance, provide a single rail on the top of the revolver, that is attached to the revolver through a tapped hole that is drilled into the frame group of the revolver.

The present description proceeds with respect to a rail system that can be mounted to a revolver without pre-altering the revolver. In one example, the rail system is a quad rail system that can be securely mounted to the revolver, but the rail system can also be a single rail system or another multi rail system, other than a quad rail system.

FIG. 1 is a side pictorial illustration of one example of a revolver 100. Revolver 100 that has a grip 102, barrel 104, hammer 106, trigger 108, trigger guard 112, cylinder 114, cylinder release actuator 116, and ejector rod 118. Barrel 104 terminates at its forward end in muzzle 120 and terminates at its rearward end at shoulder 174. Revolver 100 is also shown with a front sight 122.

Cylinder 114 can be opened by actuating cylinder release actuator 116. Cylinder 114 can then be rotated away from the frame group of revolver 100 on a crane (not specifically shown in FIG. 1). Cylinder 114 defines a set of chambers that receive cartridges. Once opened, the chambers can be loaded and cylinder 114 can be closed to the position shown in FIG. 1. When trigger 108 is depressed, hammer 106 contacts a primer causing a projectile to be fired through barrel 104.

Figure 2:
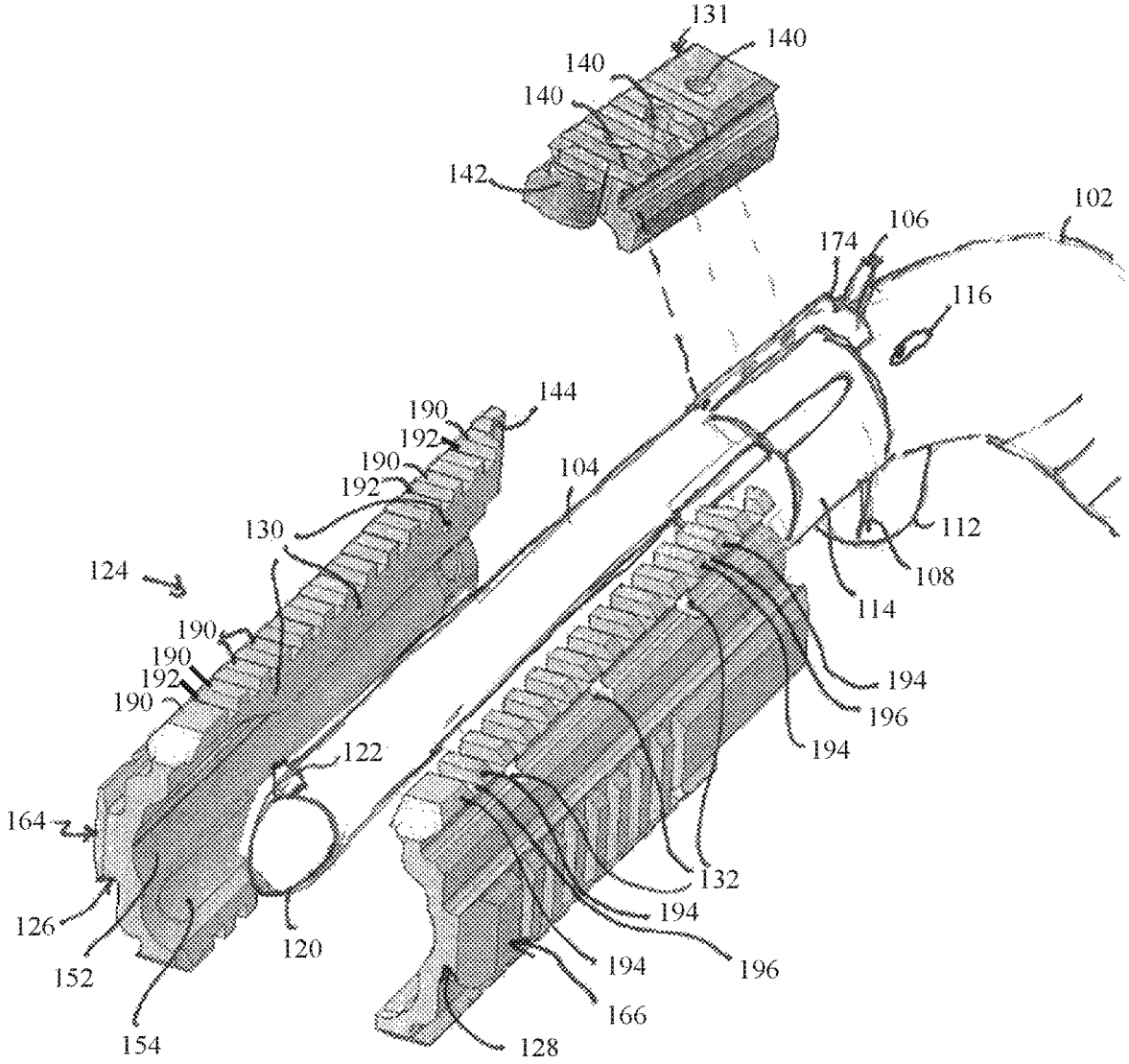
FIG. 2 is an exploded view showing a rail system positioned for mounting to a revolver.
Figure 3:
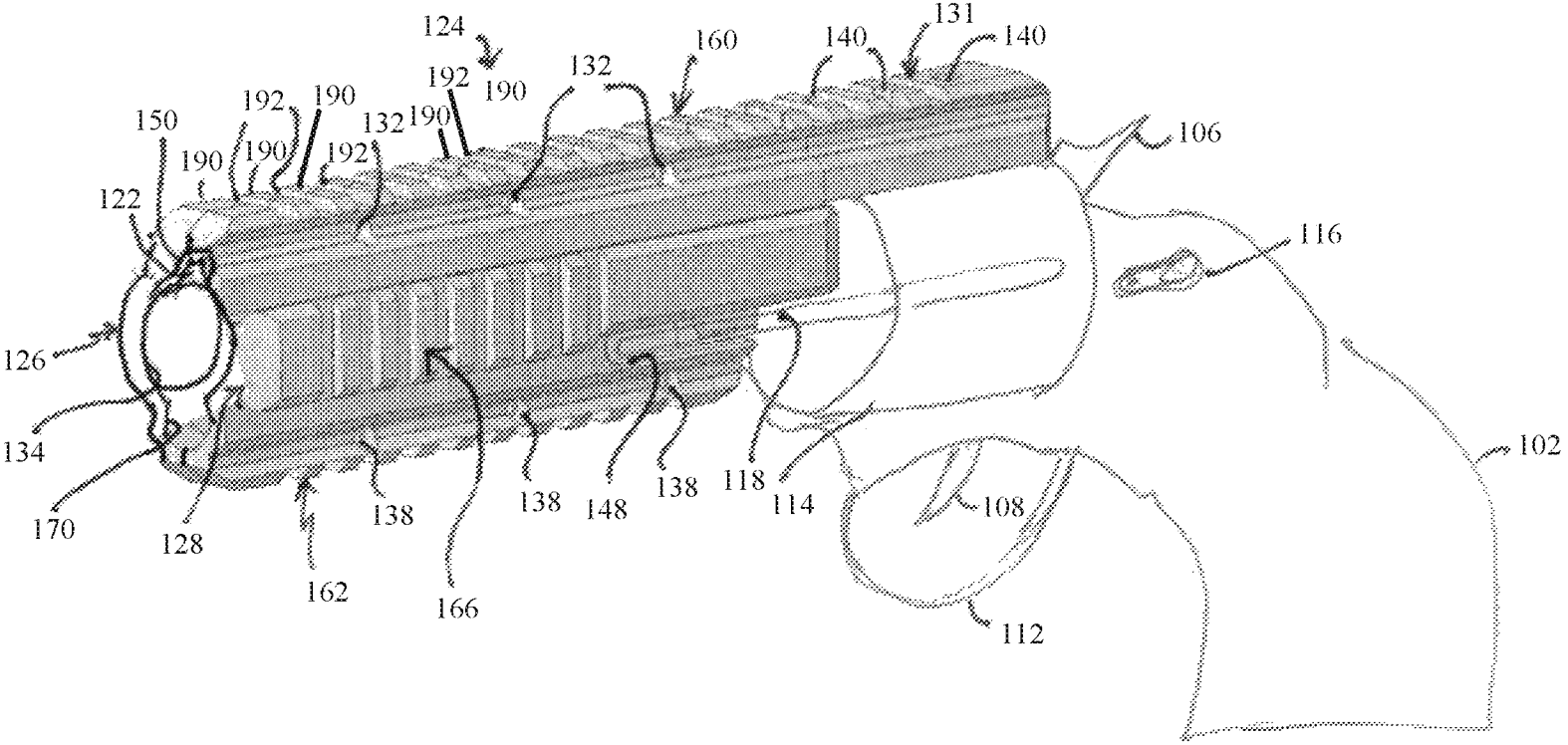
FIG. 3 shows an assembled view in which the rail system is assembled to the revolver.
Figure 4:
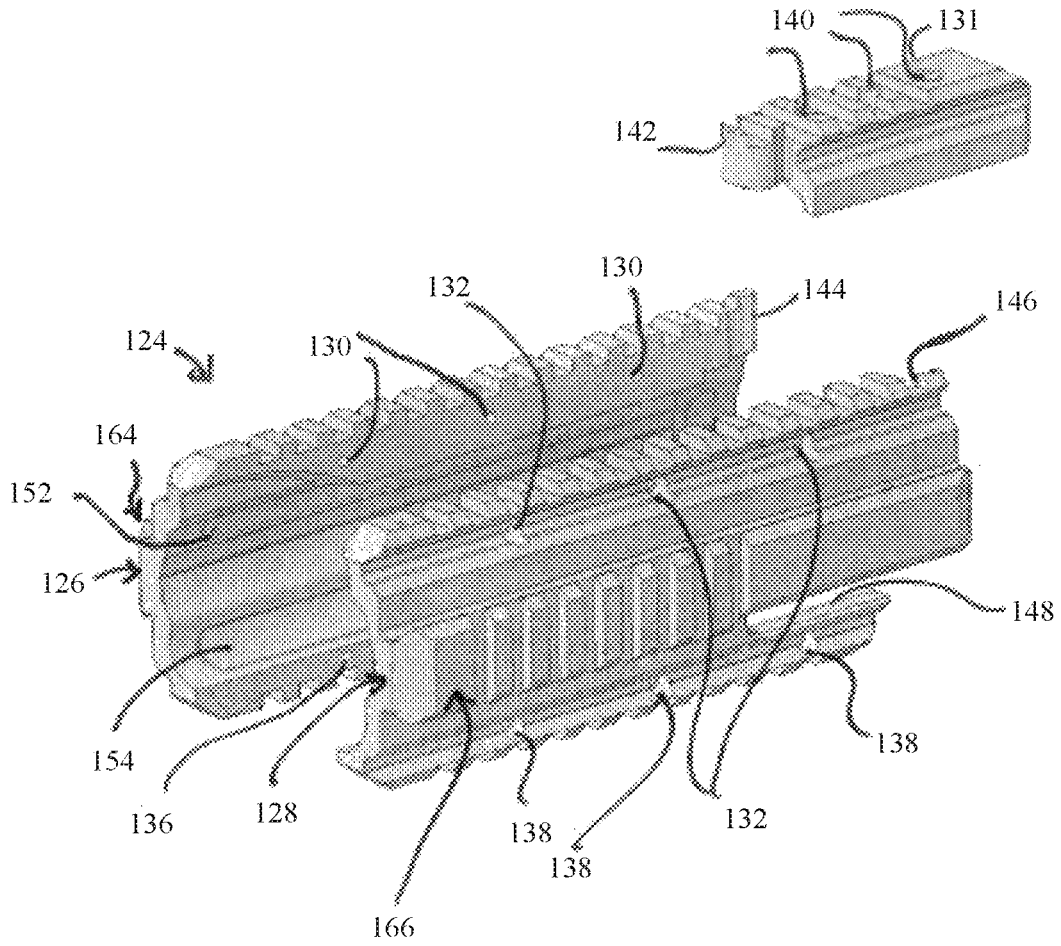
FIGS. 4 and 5 show exploded views of one example of the rail system.
Figure 5:
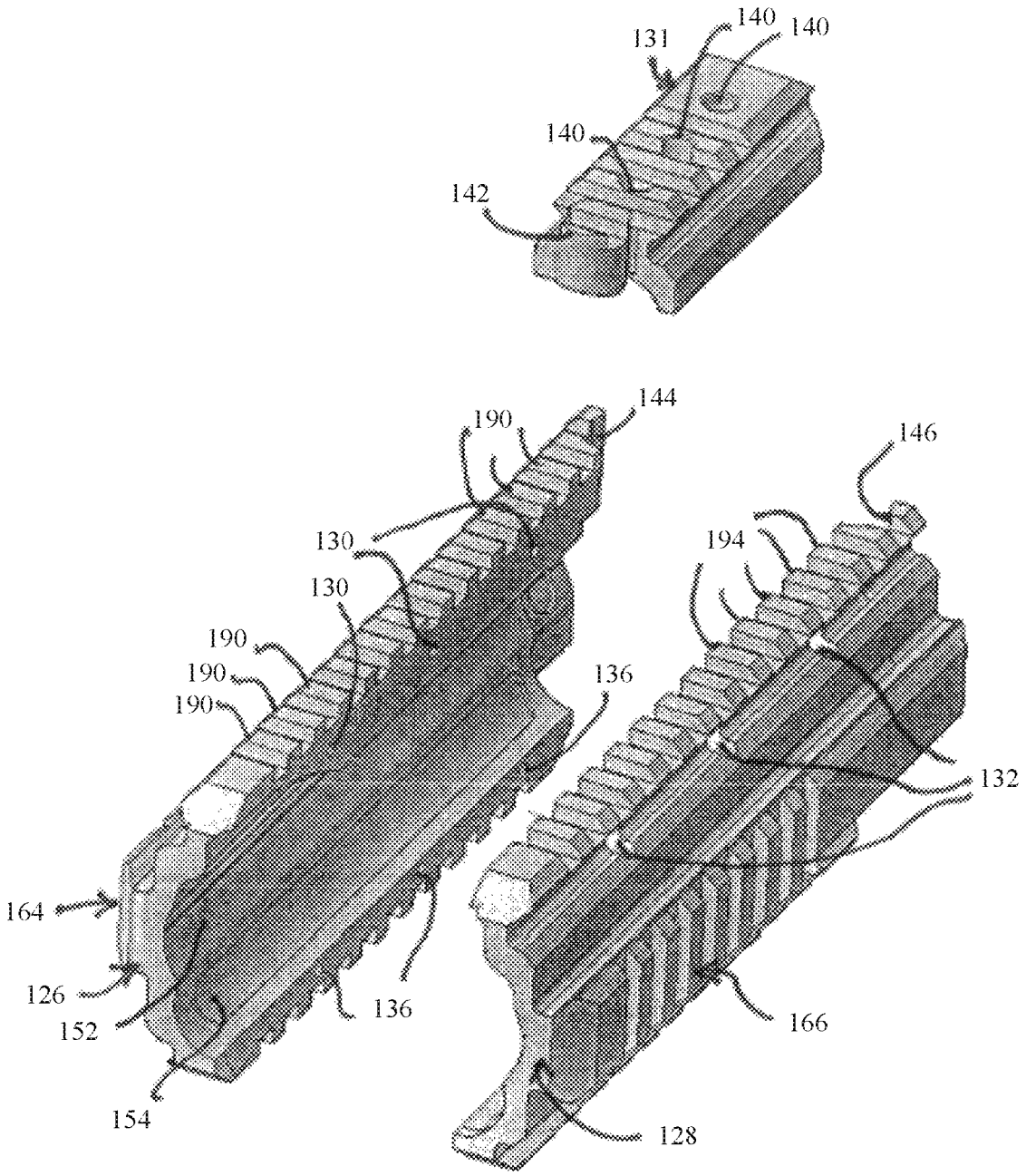

FIG. 2 is a pictorial illustration showing a quad rail system 124 exploded relative to revolver 100. FIG. 3 is a perspective view of the rail system 124 mounted onto revolver 100. FIGS. 4 and 5 show exploded views of rail system 124 without revolver 100 in the view. FIG. 4 is slightly rotated relative to the view shown in FIG. 5. FIGS. 2-5 will now be described in conjunction with one another.

Quad rail system 124 includes a first side piece 126 and a second side piece 128, as well as an upper side piece 131. Side pieces 126 and 128 have upper apertures 130 and 132, respectively, and lower apertures 136 and 138. When assembled, side pieces 126 and 128 define an elongated barrel receiving bore 134 that receives and encompasses barrel 104 of revolver 100. Apertures 130 and 132 are aligned with one another, and apertures 136 and 138 are aligned with one another, so that the two side pieces 126 and 128 of rail system 124 can be connected to one another with connectors, such as a screws, or another type of connector.

In one example, the side pieces 126 and 128 of rail system 124 can be fitted with elongate pads 152 and 154. The elongate pads 152 and 154 are shown on side piece 126, but it will be appreciated that side piece 128 may have similar pads mounted thereto. Pads 152 and 154 may be made of resilient material such as rubber or neoprene or other material with a shore A durometer in a range of, for example, 25-80. Pads 152 and 154 and pads on side piece 128 may extend along the interior surfaces of the side pieces 126 and 128 in a direction along the longitudinal axis of the barrel receiving bore 134. Thus, when screws are inserted through aligned apertures 130, 132 and 136, 138 and tightened to attach side pieces 126 and 128 to one another, the barrel and/or other structural portions of revolver 100 can be frictionally engaged by the pads 152 and 154 (and similar pads on side piece 128) so that the barrel and/or other structural portion of revolver 100 is secured by a compression fit within rail system 124.

The upper side piece 131 of rail system 124 also has a plurality of apertures 140. Apertures 140 are aligned with corresponding and pre-existing apertures on revolver 100 so that the upper side piece 131 of rail system 124 can be attached to the top of revolver 110.

Similarly, the upper side piece 131 of rail system 124 has a tab 142. When assembled, tab 142 is frictionally engaged within a tab receiving aperture formed by the interior surfaces 144 and 146 of the side pieces 126 and 128, respectively, of rail system 124.

FIGS. 3 and 4 also show that the side piece 128 of rail system 124 defines a slot 148. Slot 148 accommodates the pivotal movement of ejector rod 118 as cylinder 114 moves between the open position and the closed position.

FIG. 3 shows that sides 126 and 128 have been brought together to define the barrel receiving bore 134. Sides 126 and 128 are brought together so that the apertures 130 and 132 are aligned with one another and so that the apertures 136 and 138 are also aligned with one another. Similarly, the apertures 140 on the upper side piece 131 of rail system 124 are aligned with pre-existing holes in the top of revolver 100 so that upper side piece 131 can be fixedly attached to revolver 100 using screws or other connectors.

Also, side piece 126 has a first side rail 164, a partial upper rail 160 and a partial lower rail 162. Side piece 128 has a second side rail 166 as well as a partial upper rail 160 and a partial lower rail 162. The partial upper rail on side piece 126 is formed by a first set of lugs 190 (only some of which are labeled in the FIGS.) that define a first set of grooves 192 (only some of which are labeled in the FIGS.). The partial upper rail on side piece 128 is formed by a second set of lugs 194 (only some of which are labeled in the FIGS.) that define a second set of grooves 196 (only some of which are labeled in the FIGS.). The partial lower rail on side piece 126 also has a set of lugs that define grooves and the partial lower rail on side piece 128 also has a set of lugs that define grooves.

FIG. 3 shows that, when the side pieces 126 and 128 are connected together, the lugs 190 and 194 on the top of pieces 126 and 128 of rail system 124 are aligned with one another to define grooves forming the upper rail 160 of rail system 124. Similarly, when pieces 126 and 128 are connected together, the lower portion of rail system 124 has lugs that are aligned with one another to define grooves which form the lower rail 162 on rail system 124.

FIG. 3 also shows that tab 142 has been received within the tab receiving aperture defined by the surfaces 144 and 146 of sides 126 and 128. FIG. 3 also shows that, when assembled onto revolver 100, the upper side piece 131 of rail system 124 extends rearwardly, thus extending the upper rail 160 of rail system 124 rearwardly over cylinder 114. Thus, rail system 124 can provide a quad rail system for revolver 100.

Figure 6:
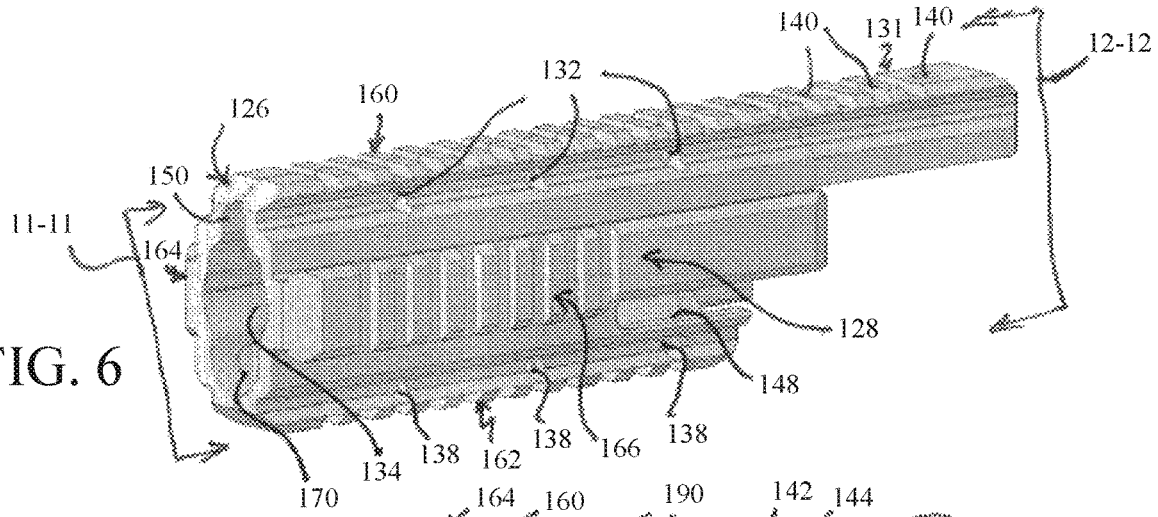
FIG. 6 is a perspective view of the rail system.
Figure 7:
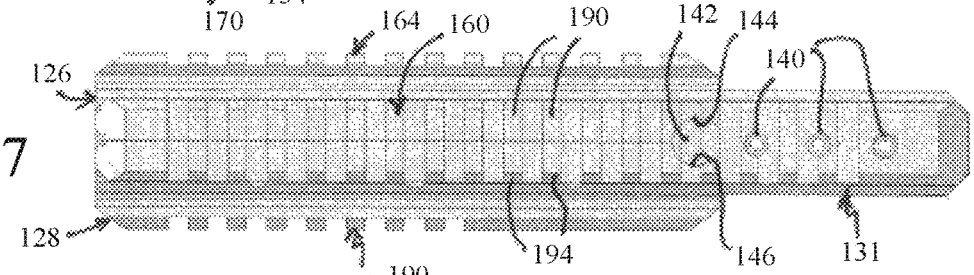
FIG. 7 is a top view of one example of the rail system.
Figure 8:
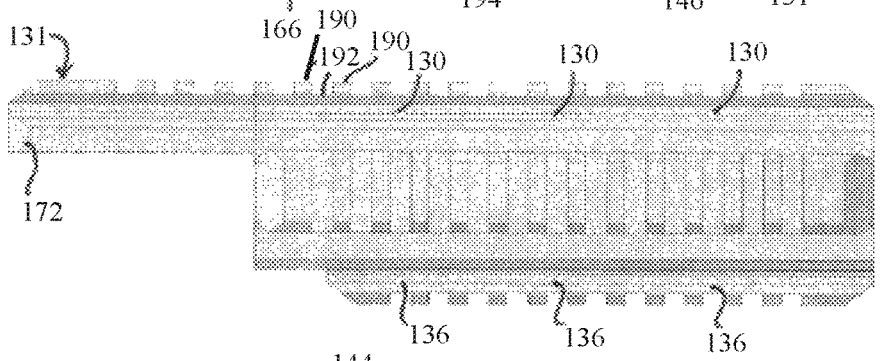
FIG. 8 is a side view of one example of the rail system, opposite the side shown in FIG. 6.
Figure 9:
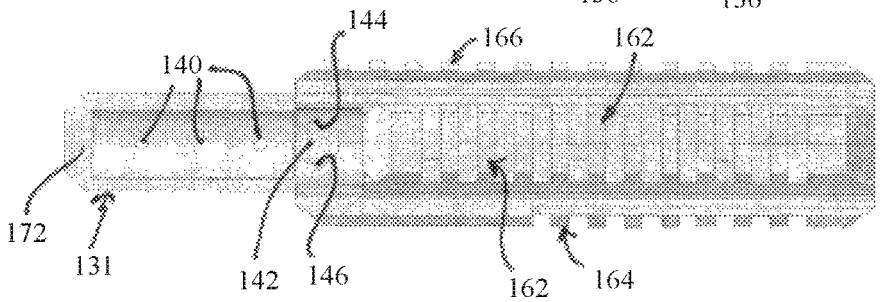
FIG. 9 is a bottom view of one example of the rail system.
Figure 10:
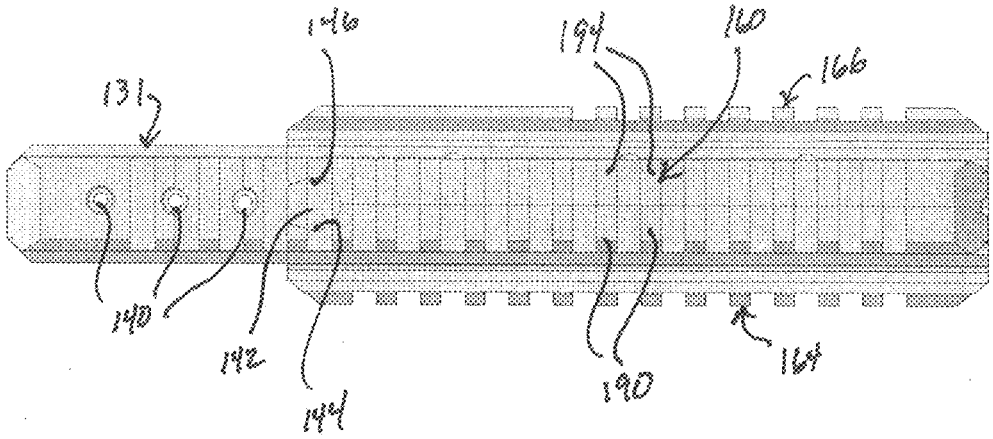
FIG. 10 is a top view of one example of the rail system.

FIGS. 6, 7, 8, 9, and 10 show different views of rail system 124 in the assembled conformation, but without revolver 100. Thus, FIG. 6 is a side perspective view of rail system 124 showing the slot 148 that accommodates the ejector rod 118 on the revolver 100. FIG. 7 shows a top view of rail system 124 in the configured position and FIG. 8 shows a side view of rail system 124. The side shown in FIG. 8 is generally opposite that shown in FIG. 6. FIG. 9 shows a bottom view of rail system 124, and FIG. 10 is also a top view of rail system 124 rotated 180° about an axis into and out of the page of FIG. 10 from the top view shown in FIG. 7.

As also shown in FIG. 3, when rail system 124 is assembled, the top portions of side pieces 126 and 128 define a sight-receiving aperture or cavity 150. Cavity 150 is sized sufficiently to accommodate the front sight 122 of revolver 100.

Figure 11:
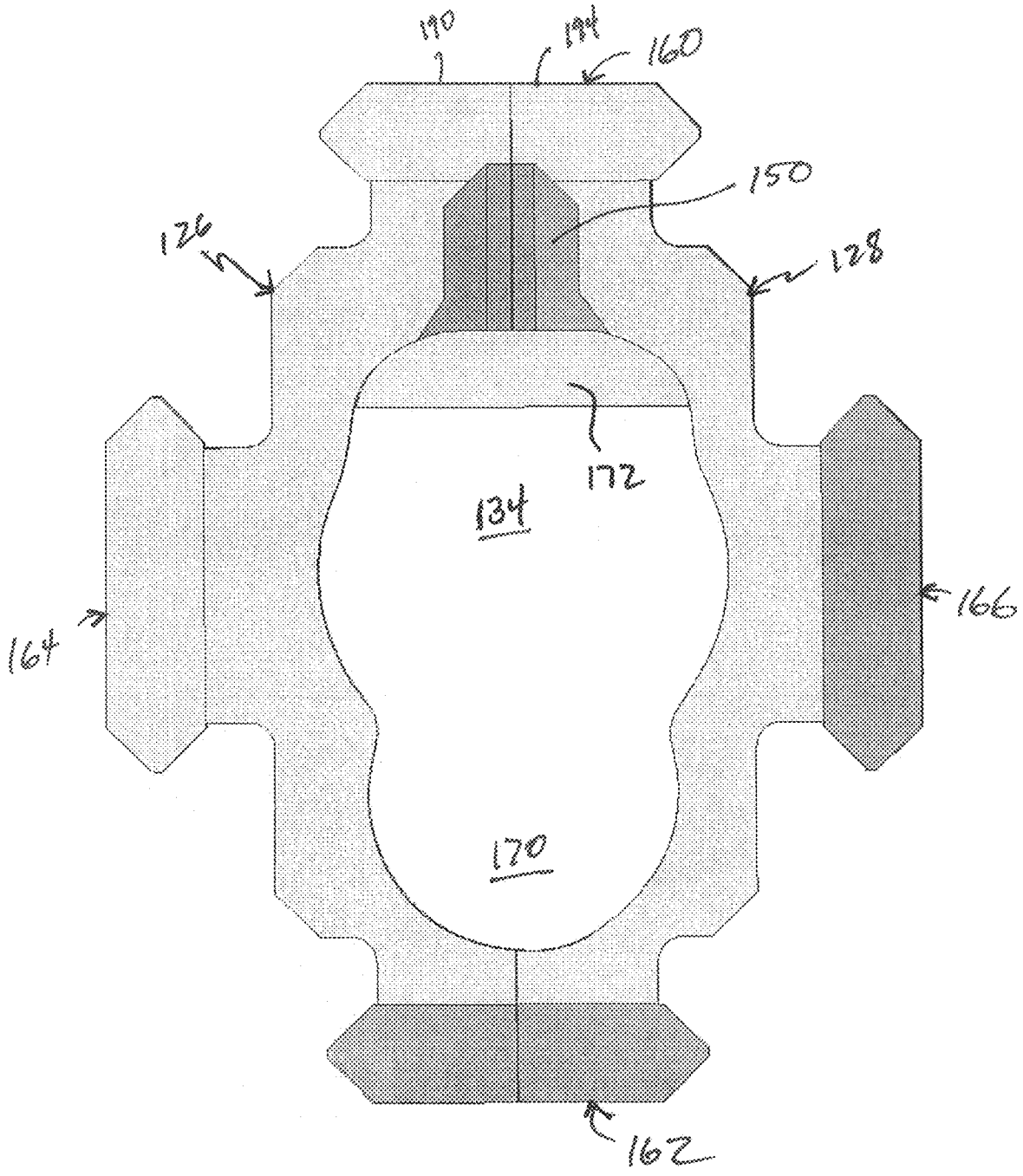
FIG. 11 is a front view of one example of the rail system.

FIG. 11 is a front view taken from the perspective indicated by line 11-11 shown in FIG. 6. FIG. 11 illustrates the position of top rail 160, bottom rail 162, and side rails 164 and 166. FIG. 11 also illustrates the sight receiving cavity 150 defined by the upper, internal surfaces of side pieces 126 and 128 of rail system 124 once side pieces 126 and 128 are connected to one another. FIG. 11 also illustrates that the side pieces 126 and 128 not only define the barrel receiving bore 134 but can also define a lower bore 170. Lower bore 170 can receive structural portions of revolver 100 that extend below barrel 104.

Figure 12:
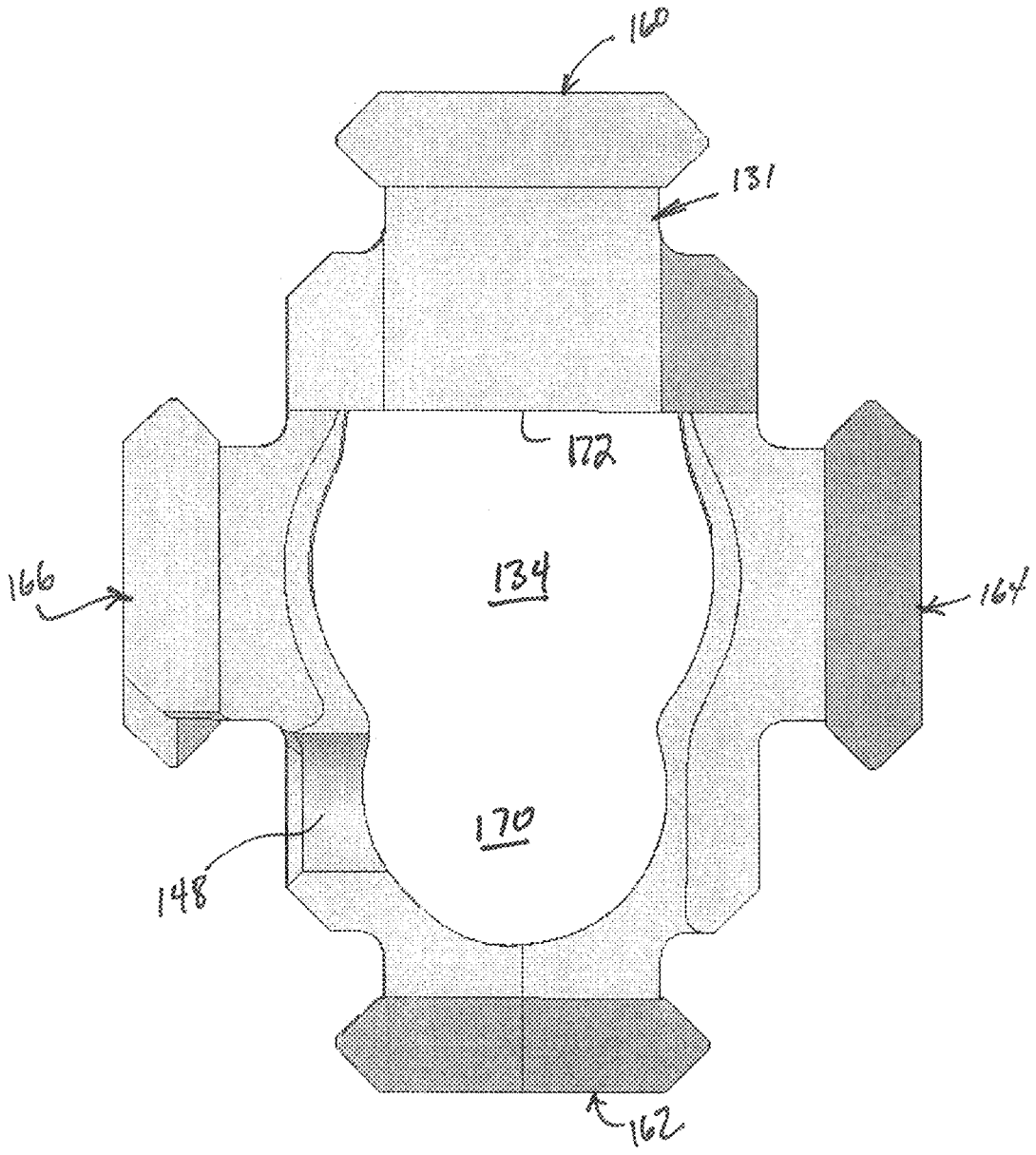
FIG. 12 is a rear view of one example of the rail system.

FIG. 12 is a rearview of rail system 124 taken generally in the direction indicated by line 12-12 shown in FIG. 6. FIG. 12 thus more clearly illustrates the slot 148 that accommodates ejector rod 118. Further, FIG. 12 shows that the rearward portion of upper side piece 131 includes a downwardly extending tab 172. Tab 172, when mounted to revolver 100, abuts and frictionally engages shoulder 174 on revolver 100. Because tab 172 frictionally engages shoulder 174, tab 172 more snugly holds rail system 124 on revolver 100 and inhibits rail system 124 from migrating forward on revolver 100, during use.

Figure 13:
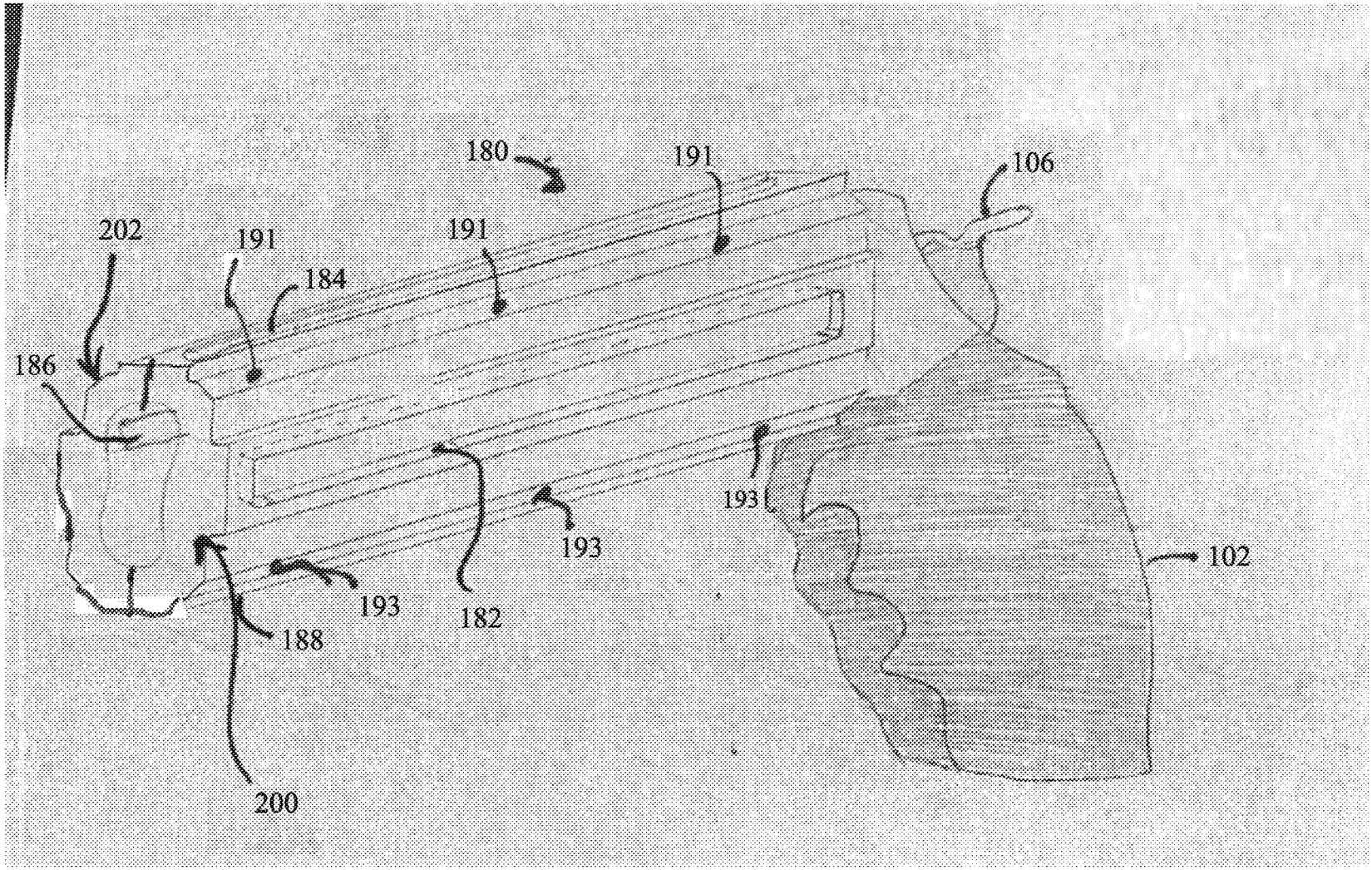
FIG. 13 shows one example of a rail system with an M-lok configuration.

FIG. 13 shows another example of a rail system 180 that is configured for attachment to revolver 100. Rail system 180 has a first side piece 200 and a second side piece 202. Side piece 200 defines an elongate slot 182, half of an upper elongate slot 184, and half of a lower elongate slot 188. Side piece 202 defines an elongate slot 186, generally opposite slot 182 on side piece 200, the other half of upper elongate slot 184 (that cooperates with the half defined by side piece 200), and the other half of lower elongate slot 188 (which cooperates with the half defined by side piece 202). Thus, when side pieces 200 and 202 are connected to one another, rail system 180 has two side elongate slots 182 and 186, an upper elongate slot 184, and a lower elongate slot 188.

The elongate slots 182, 184, 186, and 188 can be used to attach accessories. The accessories may be mounted with a screw and a T-nut. The T-nut is aligned with and inserted within an elongate slot and the screw is turned 90° to mount an accessory to the rail system 180.

As with rail system 124, rail system 180 also includes a plurality of upper apertures 191 on side piece 200 and a plurality of lower apertures 193, also on side piece 200. Apertures 191 cooperate with corresponding apertures on side piece 202 so that screws or other connection pins can be inserted into apertures 191 to secure side pieces 200 and 202 together. Similarly, lower apertures 193 on side piece 200 cooperate with corresponding apertures on side 202 so that a screw or other connection pin can be inserted into the cooperating apertures to securely fasten side pieces 200 and 202 together.

Rail system 180 can also be formed with a slot in side piece 200 (similar to slot 148 in previous FIGS.) to accommodate an extractor rod. Rail system 180 can also include an upper side piece (similar to piece 131 of rail system 124) which can extend rearwardly toward the shoulder 174 of revolver 100 to extend the upper rail system yet allow cylinder 114 to be opened and rotated outwardly.

It can thus be seen that the present discussion describes a rail system for a revolver. The rail system can be configured as a single rail system or a multi rail system (e.g., quad rail system) with openings that accommodate the extractor rod and cylinder on the revolver. The rail system can be attached to the revolver without modifying the frame group of the revolver in any way. This allows optics and other accessories to be easily mounted to a revolver, as desired by the user. The rail system is shown as having right and left side pieces that connect together with connectors above and below the barrel of the revolver. However, the rail system could have an upper side piece and a lower side piece that connect together with connectors on the right and left sides of the barrel of the revolver. The rail system is shown having two or three pieces, but the rail system could have another number of pieces as well and be configured in other ways. These and other configurations are contemplated herein.

It should also be noted that the different examples described herein can be combined in different ways. That is, parts of one or more examples can be combined with parts of one or more other examples. All of this is contemplated herein. Although the subject matter has been described in language specific to structural features and/or methodological acts, it is to be understood that the subject matter defined in the appended claims is not necessarily limited to the specific features or acts described above. Rather, the specific features and acts described above are disclosed as example forms of implementing the claims.

What is claimed is:

1. A rail system, comprising:

a first side piece having a forward end, a rearward end and an inner surface;

a second side piece having a forward end, a rearward end and an inner surface, the inner surfaces of the first and second side pieces being configured to, when the first side piece and the second side piece are connected together, form an elongate barrel receiving bore sized to frictionally engage a revolver barrel and provide a first rail coupled to the revolver;

a first resilient pad mounted to the first side piece; and a second resilient pad mounted to the second side piece and the first and second pads being configured, when the first and second side pieces are connected together, along the elongate barrel receiving bore to frictionally engage the revolver barrel.

2. The rail system of claim 1 wherein the first side piece defines a first set of apertures, and the second side piece defines a second set of apertures, the first and second sets of apertures being positioned to receive a set of connectors to connect the first side piece to the second side piece.

3. The rail system of claim 1 wherein the revolver includes an ejector rod and a cylinder movable between an open position and a closed position, and wherein the first side piece of the rail system defines a slot that is positioned to accommodate movement of the ejector rod as the cylinder is moved between the open position and the closed position.

4. The rail system of claim 1 wherein the inner surfaces of the first and second side pieces define a front sight cavity configured to receive a front sight disposed on the revolver barrel.

5. The rail system of claim 1 and further comprising:

a top side piece configured to be mounted to a top side of the revolver barrel.

6. The rail system of claim 5 wherein the top side piece further comprises;

a depending tab configured to, when the top side piece is coupled to the revolver barrel, frictionally engage a shoulder at a rearward end of the revolver barrel.

7. The rail system of claim 6 wherein the first side piece and the second side piece, when connected together, define a tab receiving opening.

8. The rail system of claim 7 wherein the top side piece comprises:

a forward tab that fits into and is frictionally engaged by the tab receiving opening.

9. The rail system of claim 8 wherein the depending tab is configured to engage the shoulder and the forward tab is configured to couple the first and second side pieces to limit forward movement of the rail system in a direction generally parallel to a longitudinal axis of the barrel receiving bore.

10. The rail system of claim 5 wherein the first side piece comprises;

a first rail;

a first upper set of lugs defining a first upper set of grooves; and a first lower set of lugs defining a first lower set of grooves.

11. The rail system of claim 10 wherein the second side piece comprises;

a second rail;

a second upper set of lugs defining a second upper set of grooves; and a second lower set of lugs defining a second lower set of grooves.

12. The rail system of claim 11 wherein, when the first and second side pieces are connected together, the first upper set of lugs is aligned with the second upper set of lugs to define an upper rail and the first lower set of lugs is aligned with the second lower set of lugs to define a lower rail.

13. The rail system of claim 11 wherein the top side piece has a third set of lugs that define a rearward extension of the upper rail.

14. The rail system of claim 5 wherein the first side piece comprises;

a first elongate slot defining a first rail;

a first upper partial slot; and a first lower partial slot.

15. The rail system of claim 14 wherein the second side piece comprises;

a second elongate slot defining a second rail;

a second upper partial slot; and a second lower partial slot.

16. The rail system of claim 15 wherein, when the first and second side pieces are connected together, the first upper partial slot is aligned with the second upper partial slot to define an upper rail and the first lower partial is aligned with the second lower partial to define a lower rail.

17. The rail system of claim 16 wherein the top side piece has a third elongate slot that defines a rearward extension of the upper rail.

18. A revolver rail system, comprising:

a first piece defining a first rail, a first partial rail, and a second partial rail; and a second piece defining a second rail, a third partial rail, and a fourth partial rail, the first and second pieces being connectable to align the first partial rail with the third partial rail to form a third rail and to align the second partial rail with the fourth partial rail to define a fourth rail.

19. A rail system, comprising:

a first side piece having a forward end, a rearward end and an inner surface;

a second side piece having a forward end, a rearward end and an inner surface, the inner surfaces of the first and second side pieces being configured to, when the first side piece and the second side piece are connected together, form an elongate barrel receiving bore sized to frictionally engage a revolver barrel and provide a first rail coupled to the revolver;

a top side piece configured to be mounted to a top side of the revolver barrel, wherein the top side piece comprises a depending tab configure to, when the top side piece is coupled to the revolver barrel, frictionally engage a shoulder at a rearward end of the revolver barrel.

20. A rail system, comprising:

a first side piece having a forward end, a rearward end and an inner surface, the first side piece comprising a first rail, a first upper set of lugs defining a first upper set of grooves, and a first lower set of legs defining a first lower set of grooves;

a second side piece having a forward end, a rearward end and an inner surface, the inner surfaces of the first and second side pieces being configured to, when the first side piece and the second side piece are connected together, form an elongate barrel receiving bore sized to frictionally engage a revolver barrel and provide a first rail coupled to the revolver; and a top side piece configured to be mounted to a top side of the revolver barrel.

21. A rail system, comprising:

a first side piece having a forward end, a rearward end, and an inner surface, a first elongate slot defining a first rail, a first upper partial slot, and a first lower partial slot;

a second side piece having a forward end, a rearward end and an inner surface, the inner surfaces of the first and second side pieces being configured to, when the first side piece and the second side piece are connected together, form an elongate barrel receiving bore sized to frictionally engage a revolver barrel and provide a first rail coupled to the revolver; and a top side piece configured to be mounted to a top side of the revolver barrel.

* * * * *